US008037888B2

(12) United States Patent
Larios

(10) Patent No.: US 8,037,888 B2
(45) Date of Patent: Oct. 18, 2011

(54) RECONFIGURABLE SMOKING PIPE

(76) Inventor: Leonard Gabriel Larios, Exeter, CA (US)

( * ) Notice: Subject to any disclaimer, the term of this patent is extended or adjusted under 35 U.S.C. 154(b) by 827 days.

(21) Appl. No.: 12/119,509

(22) Filed: May 13, 2008

(65) Prior Publication Data

US 2009/0283102 A1 Nov. 19, 2009

(51) Int. Cl.
*A24F 5/00* (2006.01)

(52) U.S. Cl. ..... 131/222; 131/178; 131/185; 131/198.1; 131/221; 131/223; 131/225

(58) Field of Classification Search ..... None
See application file for complete search history.

(56) References Cited

U.S. PATENT DOCUMENTS 3,286,715 A * 11/1966 Teaford, Sr. ..... 131/215.1
4,146,042 A 3/1979 Maiorana
4,223,687 A * 9/1980 Sandeen ..... 131/180
5,417,227 A 5/1995 West
2004/0187879 A1 9/2004 Iordan
* cited by examiner

*Primary Examiner* — Richard Crispino
*Assistant Examiner* — Michael J Felton
(74) *Attorney, Agent, or Firm* — Ashok Tankha; Lipton, Weinberger & Husick

(57) ABSTRACT

Disclosed herein is a reconfigurable smoking pipe and a method of using the same for single handed operation. The reconfigurable smoking pipe comprises a base unit, a lighter holder, a bowl, a smoke chamber, a carburetor, a mouthpiece, and a plug. The base unit comprises multiple ports. The lighter holder is attached to the base unit. Each of the bowl, the smoke chamber, the carburetor, and the plug are detachably attached to any one of the ports of the base unit. A mouthpiece is detachably attached to anterior end of the smoke chamber. A user assembles the reconfigurable smoking pipe and inserts a lighter into the lighter holder. The user holds the reconfigurable smoking pipe in a smoking position using a single hand by gripping the inserted lighter and lights a smoking substance held in the bowl by operating the gripped lighter using the single hand.

4 Claims, 3 Drawing Sheets

RECONFIGURABLE SMOKING PIPE

BACKGROUND

This invention relates to the field of smoking implements. More specifically, this invention relates to a reconfigurable smoking pipe.

Smoking implements such as smoking pipes are widely used by smokers to smoke tobacco. Smoking pipes typically require an external lighter or matches to be used for lighting the tobacco. A user usually must hold a smoking pipe in one hand and a lighter or a match in the other hand while lighting. Moreover, tools such as a pipe cleaner or a reamer must be used to clean the smoking pipe. Smoking pipes are generally built as a single unit and dismantling the smoking pipes requires expert knowledge.

Hence, there is a need for a smoking pipe that requires only a single hand for gripping and lighting. There is also a need for a smoking pipe that may be easily dismantled for cleaning and for reconfigurable positioning.

SUMMARY OF THE INVENTION

This summary is provided to introduce a selection of concepts in a simplified form that are further described in the detailed description of the invention. This summary is not intended to identify key or essential inventive concepts of the claimed subject matter, nor is it intended for determining the scope of the claimed subject matter.

The apparatus and method disclosed herein address the above stated needs for single handed operation of a smoking pipe that may be easily dismantled for cleaning and reconfigurable positioning. The reconfigurable smoking pipe comprises a base unit, a lighter holder, a bowl, a smoke chamber, a mouthpiece, a carburetor, and a plug. The base unit comprises multiple ports. The lighter holder is attached to the base unit. A user assembles the reconfigurable smoking pipe and inserts a lighter into the lighter holder.

The lighter holder detachably holds the lighter. The bowl for holding a smoking substance is detachably attached to one of the ports of the base unit. The user lights the smoking substance inside the bowl using the lighter with a single hand. The posterior end of the smoke chamber is detachably attached to one of the ports of the base unit. The smoke chamber accumulates smoke produced on lighting the smoking substance. The mouthpiece for allowing a user to inhale the smoke from the smoke chamber is detachably attached to the anterior end of the smoke chamber. The carburetor is detachably attached to one of the ports of the lighter holder. The carburetor enables the user to inhale residual smoke from the smoke chamber. The plug for containing the smoke within the smoke chamber is detachably attached to one of the ports of the base unit.

The detachable attachment allows the bowl, the smoke chamber, the carburetor, and the plug to be reconfigurably positioned on the base unit. The detachable attachment also allows disassembly for easy cleaning. The detachable attachment further allows the assembly of the smoke chamber with the mouthpiece to be repositioned on any one of the ports based on left handedness and right handedness of the user. The apparatus disclosed herein enables single handed operation by the user.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and instrumentalities disclosed herein.

DETAILED DESCRIPTION OF THE INVENTION

Figure 1:
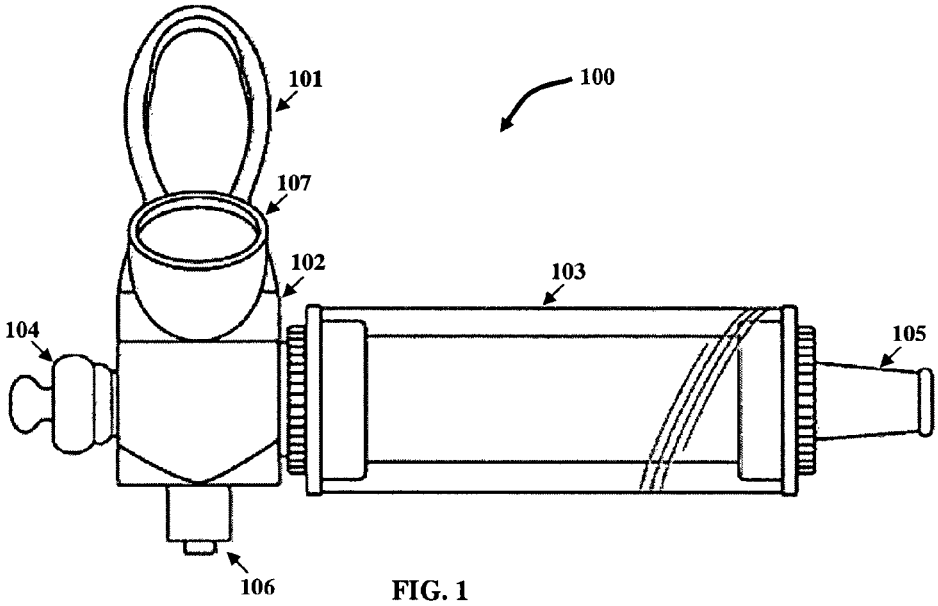
FIG. 1 illustrates a top view of a reconfigurable smoking pipe.

FIG. 1 illustrates a top view of a reconfigurable smoking pipe 100. The reconfigurable smoking pipe 100 comprises a base unit 102, a lighter holder 101, a bowl 107, a smoke chamber 103, a carburetor 104, a mouthpiece 105, and a plug 106. The base unit 102 comprises a plurality of ports. The base unit 102 may be made of glass, aluminum, ceramic, copper, steel, or synthetic substances.

Figure 2:
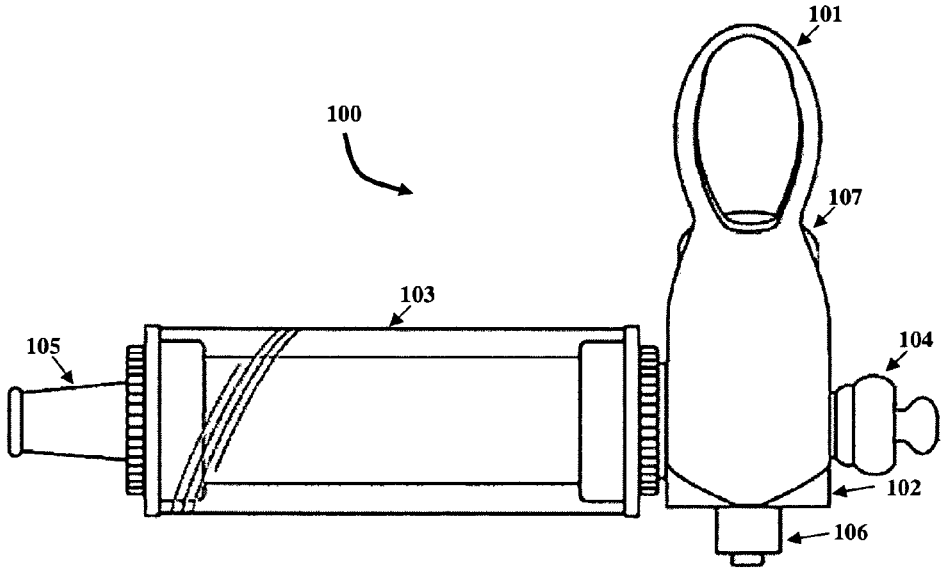
FIG. 2 illustrates a bottom view of the reconfigurable smoking pipe.
Figure 4:
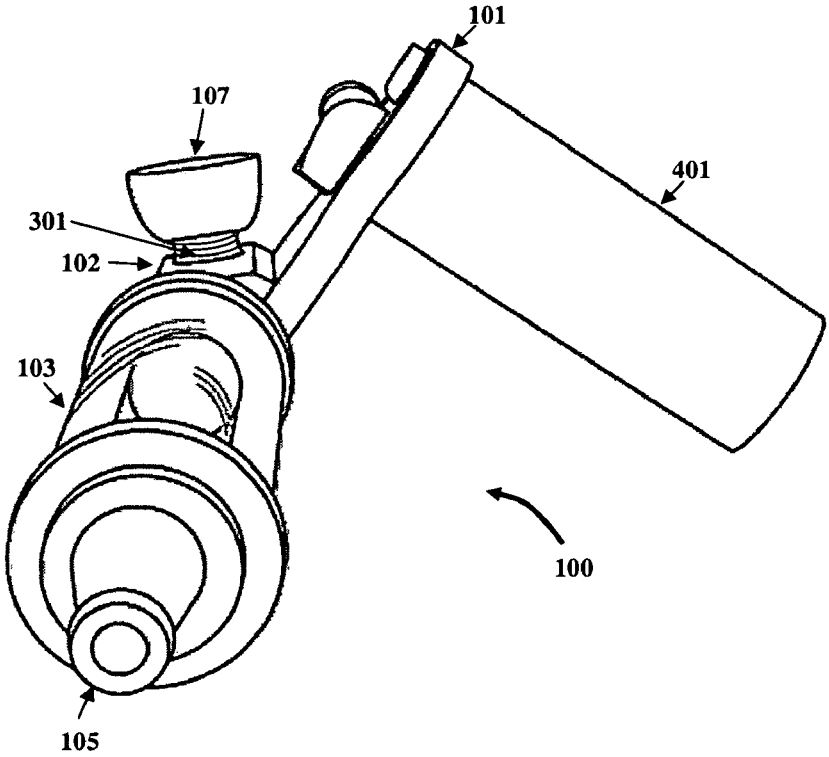
FIG. 4 exemplarily illustrates a reconfigurable smoking pipe holding a lighter.

The lighter holder 101 is attached to the base unit 102, as illustrated in FIG. 2. The lighter holder 101 detachably holds a lighter 401, as exemplarily illustrated in FIG. 4. The lighter 401 may be used as a handle by a user. The bowl 107 is detachably attached to one of the ports of the base unit 102. The bowl 107 may comprise a threaded base 301 for attaching the bowl 107 to one of the ports of the base unit 102. The bowl 107 holds a smoking substance, for example tobacco. The bowl 107 may be inclined at an angle, for example 45 degrees, to the lighter 401, for enabling flame from the lighter 401 to make contact with the smoking substance held by the bowl 107. The lighter 401 lights the smoking substance in the bowl 107, thereby causing the smoking substance to produce smoke. A bottom view of the reconfigurable smoking pipe 100 is illustrated in FIG. 2.

Figure 3:
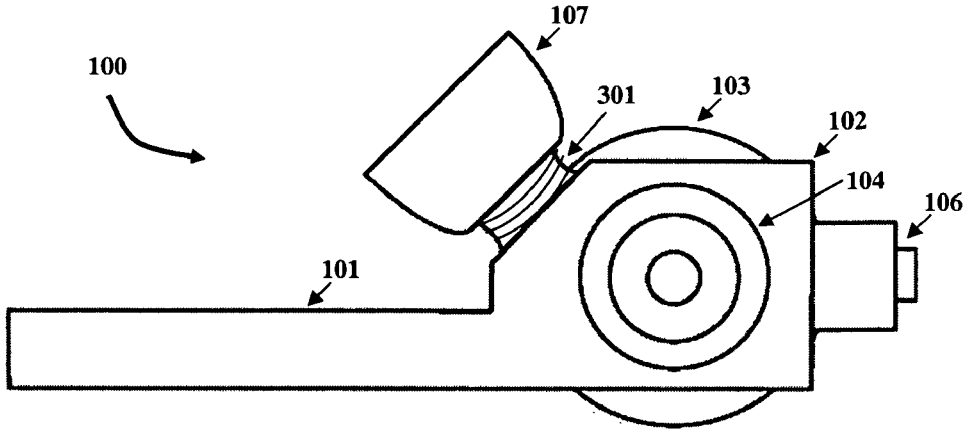
FIG. 3 illustrates a back view of the reconfigurable smoking pipe.

The posterior end of the smoke chamber 103 is detachably attached to one of the ports of the base unit 102. The smoke produced by the smoking substance accumulates in the smoke chamber 103. The user may inhale the smoke in the smoke chamber 103 through the mouthpiece 105. The mouthpiece 105 is detachably attached to the anterior end of the smoke chamber 103. The carburetor 104 is detachably attached to one of the ports of the base unit 102. The carburetor 104 enables the user to inhale residual smoke from the smoke chamber 103. The user may place a finger over the carburetor 104 during lighting. To inhale the residual smoke from the smoke chamber 103, the user may release the finger placed over the carburetor 104 and draw the residual smoke through the mouthpiece 105 until the smoke chamber 103 is cleared of the residual smoke. Hence, the user is able to inhale the residual smoke through the mouthpiece 105 using a single hand. The plug 106 is detachably attached to one of the ports of the base unit 102. The plug 106 is used to contain the smoke within the smoke chamber 103. A back view of the reconfigurable smoking pipe 100 is illustrated in FIG. 3. A reconfigurable smoking pipe 100 holding a lighter 401 is exemplarily illustrated in FIG. 4.

The detachable attachment allows each of the lighter holder 101, the bowl 107, the smoke chamber 103, the carburetor 104, and the plug 106 to be reconfigurably positioned on any one of the ports of the base unit 102. The detachable attachment also allows disassembly of the reconfigurable smoking pipe 100 for easy cleaning. The detachable attachment further allows repositioning of assembly of the smoke chamber 103 with the mouthpiece 105 on any port of the base unit 102, based on left handedness or right handedness of the user.

Figure 5:
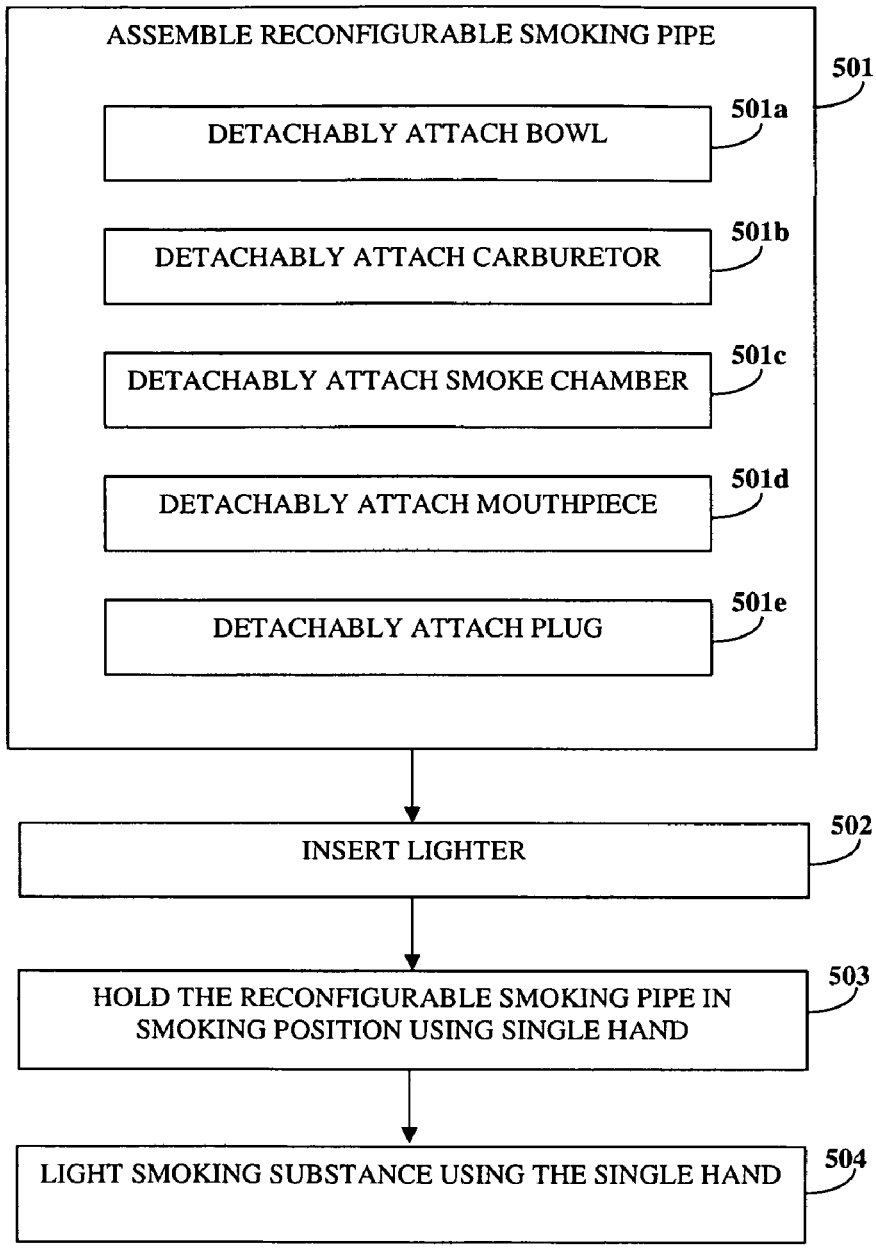
FIG. 5 illustrates a method of using a reconfigurable smoking pipe.

FIG. 5 illustrates a method of using a reconfigurable smoking pipe 100. A user may assemble 501 a reconfigurable smoking pipe 100 as follows: the user detachably attaches 501*a* a bowl 107 for holding a smoking substance to one of the multiple ports of a base unit 102. The lighter holder 101 is attached to the base unit 102. The user detachably attaches 501*b* a carburetor 104 to one of the ports of the base unit 102. The user detachably attaches 501*c* the posterior end of a smoke chamber 103 to one of the ports of the base unit 102. The user detachably attaches 501*d* a mouthpiece 105 to the anterior end of the smoke chamber 103. The user detachably attaches 501*e* a plug 106 to one of the ports of the base unit 102. The user inserts 502 a lighter 401 into the lighter holder 101. The user holds 503 the reconfigurable smoking pipe 100 in a smoking position by gripping the inserted lighter 401 with one hand. The user then lights 504 the smoking substance held in the bowl 107 by operating the gripped lighter using the same hand.

The detachable attachment of the base unit 102, the lighter holder 101, the bowl 107, the smoke chamber 103, the carburetor 104, the mouthpiece 105, and the plug 106 enables the reconfigurable assembly of the reconfigurable smoking pipe 100. The user may use the reconfigurable smoking pipe 100 for smoking by holding the lighter 401 with a single hand.

The apparatus disclosed herein therefore enables single handed operation by the user. The single handed operation includes the user gripping the reconfigurable smoking pipe 100 by the inserted lighter 401 and lighting the smoking substance using the lighter 401 with a single hand.

Consider an example of a user smoking tobacco. The user assembles the reconfigurable smoking pipe 100. The user inserts a lighter 401 into the lighter holder 101. The user holds the reconfigurable smoking pipe 100 in a smoking position by gripping the inserted lighter 401 with one hand. The user then lights 504 the tobacco held in the bowl 107 by operating the gripped lighter using the same hand. While lighting, the user places a finger of the same hand over the carburetor 104. The smoke produced by the tobacco accumulates in the smoke chamber 103. The plug 106 allows the smoke to be contained within the smoke chamber 103. The user inhales the smoke from the smoke chamber 103 through the mouthpiece 105. The user removes the finger placed over the carburetor 104. The carburetor 104 enables the user to inhale the residual smoke from the smoke chamber 103. The reconfigurable smoking pipe 100 thereby enables the user to smoke tobacco by using a single hand.

The foregoing examples have been provided merely for the purpose of explanation and are in no way to be construed as limiting of the present method and system disclosed herein. While the invention has been described with reference to various embodiments, it is understood that the words, which have been used herein, are words of description and illustration, rather than words of limitation. Further, although the invention has been described herein with reference to particular means, materials and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may effect numerous modifications thereto and changes may be made without departing from the scope and spirit of the invention in its aspects.

I claim:

1. A reconfigurable smoking pipe, comprising:

a base unit comprising a plurality of ports;

a lighter holder attached to said base unit, wherein said lighter holder detachably holds a lighter;

a bowl detachably attached to one of said ports of the base unit, wherein said bowl holds a smoking substance;

a smoke chamber detachably attached to one of the ports of the base unit at posterior end of said smoke chamber, wherein the smoke chamber accumulates smoke produced on lighting said smoking substance;

a mouthpiece detachably attached to anterior end of the smoke chamber, wherein said mouthpiece allows a user to inhale said smoke from the smoke chamber;

a carburetor detachably attached to one of the ports of the base unit, wherein said carburetor enables said user to inhale residual smoke from the smoke chamber; and a plug detachably attached to one of the ports of the base unit, wherein said plug is used to contain the smoke within the smoke chamber;

whereby said detachably attaching allows each of the lighter holder, the bowl, the smoke chamber, the carburetor, and the plug to be reconfigurably positioned on the base unit using any one of the ports;

whereby said detachable attachment allows each of the lighter holder, the bowl, the smoke chamber, the carburetor, and the plug to be reconfigurably positioned on the base unit using any one of the ports.

2. The reconfigurable smoking pipe of claim 1, wherein the bowl comprises a threaded base for fixing the bowl to one of the ports of the base unit.

3. The reconfigurable smoking pipe of claim 1, wherein assembly of the smoke chamber with the mouthpiece is repositioned on any one of the ports based on left handedness and right handedness of the user.

4. A method of using a reconfigurable smoking pipe, comprising the steps of:

assembling said reconfigurable smoking pipe by a user, comprising the steps of:

detachably attaching a bowl to one of a plurality of ports of a base unit, wherein a lighter holder is attached to said base unit;

detachably attaching a carburetor to one of said ports of the base unit;

detachably attaching posterior end of a smoke chamber to one of the ports of the base unit;

detachably attaching a mouthpiece to anterior end of said smoke chamber; and detachably attaching a plug to one of the ports of the base unit;

inserting a lighter into said lighter holder by said user;

holding the reconfigurable smoking pipe in a smoking position by the user using a single hand, wherein the user holds the reconfigurable smoking pipe by gripping said inserted lighter; and lighting a smoking substance held in said bowl by the user by operating said gripped lighter using said single hand;

whereby the lighter holder enables single handed operation by the user, wherein said single handed operation includes the user gripping the reconfigurable smoking pipe by said lighter inserted into the lighter holder and lighting said smoking substance using the lighter with the single hand.

* * * * *